United States Patent [19]

Sijsling

[11] Patent Number: 4,688,727

[45] Date of Patent: Aug. 25, 1987

[54] FINE GRINDING APPARATUS FOR LABORATORY EXPERIMENTS

[75] Inventor: Dirk Sijsling, Solingen, Fed. Rep. of Germany

[73] Assignee: F. Kurt Retsch GmbH & Co. KG, Haan, Fed. Rep. of Germany

[21] Appl. No.: 677,217

[22] PCT Filed: Mar. 2, 1984

[86] PCT No.: PCT/DE84/00043

§ 371 Date: Nov. 2, 1984

§ 102(e) Date: Nov. 2, 1984

[87] PCT Pub. No.: WO84/03453

PCT Pub. Date: Sep. 13, 1984

[30] Foreign Application Priority Data

Mar. 2, 1983 [DE] Fed. Rep. of Germany ..... 3307323

[51] Int. Cl.[4] ..... B02C 4/34

[52] U.S. Cl. ..... 241/56; 241/66; 241/259.3; 241/260; 241/261.1; 241/290

[58] Field of Search ..... 241/244, 100, 65, 66, 241/67, 55, 56, 259.3, 248, 261.1, 254, 260, 169.2, 218, 266, 264, 184, 290

[56] References Cited

U.S. PATENT DOCUMENTS

| | | | |
|---|---|---|---|
| 35,036 | 4/1862 | Palmer | 241/259.3 |
| 3,151,817 | 10/1964 | Bond et al. | 241/290 |
| 3,154,257 | 10/1964 | Wooten | 241/259.3 X |
| 3,570,775 | 3/1971 | Stavely | 241/244 |
| 3,622,086 | 11/1971 | Yamagishi | 241/56 X |
| 4,067,503 | 1/1978 | Broman . | |
| 4,307,846 | 12/1981 | Spelsberg . | |
| 4,373,674 | 2/1983 | Barrera et al. . | |

FOREIGN PATENT DOCUMENTS

| | | |
|---|---|---|
| 1115210 | 4/1956 | France . |
| 1328996 | 4/1963 | France . |
| 2183676 | 12/1973 | France . |

OTHER PUBLICATIONS

European Patent Application, 40182, 11-1981.

Artisan Industries Inc., Brochure 12-1947, Bulletin No. 4001.

*Primary Examiner*—Mark Rosenbaum

*Attorney, Agent, or Firm*—Becker & Becker, Inc.

[57] ABSTRACT

An apparatus for fine grinding of, in particular, material samples for laboratory experiments. The apparatus has a fixed grinding member and a rotating grinding member, which are disposed in such a way that each has a surface facing the other and slightly spaced therefrom, with the material which is to be ground being received and passed between these surfaces. The problem faced by such an apparatus is that samples have to be introduced and discharged one by one, so that the work is carried out as a batch process. It is also difficult to accurately adjust the grinding degree. In order to solve these problems, and to carry out a continuous grinding of hard and very hard materials, as well as to be able to adjust the grain size of the grinding, the invention proposal is that the grinding members on the one hand be a fixed cylindrical body and on the other hand be a roller body which rotates coaxially therein. A small annular gap, preferably in the order of magnitude of one half of a millimeter, remains between these two bodies. The material which is to be ground is introduced at one end face of the roller body, and the ground material is essentially discharged at the other end face of the roller body. For this purpose, appropriate devices are provided. The common central longitudinal axis of the two grinding members can be pivoted by suitable mechanisms through numerous inclined positions up to an essentially vertical position. A conical body which passes into the surface of the roller body can be disposed at at least one end face of the latter.

18 Claims, 6 Drawing Figures

33
36
25
24
19
39
18
13
12
39
24
25
40
33
34
17
11
16
14
10
13
18
19
33
40
10
12

FINE GRINDING APPARATUS FOR LABORATORY EXPERIMENTS

BACKGROUND OF THE INVENTION

1. Field of the Invention

The present invention relates to an apparatus for fine grinding of material samples, especially mineral samples for laboratory experiments, and has a fixed grinding member and a rotating grinding member, which are disposed in such a way that a surface of each faces the other with a slight gap therebetween, with the material which is to be ground being received and passed between these surfaces.

2. Description of the Prior Art

Known fine grinding apparatuses having these features are the so-called grinding arrangements according to which the material is ground between two disk-like grinding members. The disks are either disposed horizontally or vertically, so that the axis of rotation of the rotating disks extends either vertically or horizontally. Among the oldest embodiments of such grinding arrangements are flour mills having grinding stones.

The grinding arrangements of the previously described state of the art are generally designed for production purposes and have a corresponding size. Due to the circular-disk-shaped chamber in which the material is ground, the introduction of the unprocessed material and the discharge of the fine material as such do not cause any particular difficulties; however, a differentiated control of the time the material can be retained in the grinding zone, and hence the possibility for achieving a wide range of the grinding degree, either cannot be achieved at all, or can only be achieved imprecisely. However, it is exactly these requirements which are required of fine grinding apparatus for laboratory experiments, where it is important to be able to explore or study series of many different samples under various conditions.

SUMMARY OF THE INVENTION

An object of the present invention is to provide an apparatus for fine grinding of material samples, especially mineral samples for laboratory experiments, which in principle makes use of the aforementioned type of features, and at the same time can be utilized for relatively soft, hard, and even very hard materials. The apparatus should be able to operate continuously, and the granular size of the discharged material which can be achieved with this grinding apparatus should be able to be adjusted over a very wide range. It is also an object to meet the requirement of a compact manner of construction for adaptation to the space conditions in laboratories, as well as to provide a construction which protects from dust.

The apparatus of the present invention is characterized primarily in that the grinding members are constructed on the one hand as a cylindrical body which is fixed against rotation, and on the other hand as a roller body which rotates coaxially therein; a small annular gap, preferably in the order of magnitude of half of a millimeter, remains between the two grinding bodies; the material which is to be ground is conveyed between this annular gap from an introducing means on one end face of the roller body to a discharge means on the other end face of the roller body, for which purpose appropriate devices are provided; the apparatus is further characterized in that the housing which surrounds the cylindrical body is mounted on relatively resilient bearing blocks in such a way that the lower half of the inner surface of the cylindrical body is pushed upwardly against the lower half of the outer surface of the roller body.

Pursuant to specific features of the present invention the resilient bearing blocks may essentially be formed by respective compression springs. The degree of resilience of the bearing blocks for the cylindrical body of the grinding apparatus may be adapted to be adjustable by means of a hand grip.

The common central longitudinal axis of the two grinding members may be basically horizontal and may be pivotable by suitable means through numerous inclined positions up to an essentially vertical position. The housing, together with its grinding members and the drive unit, may be mounted on a chassis or support means which can be pivoted by means of a hinged connection about approximately 90° between a horizontal and a vertical position, and can be fixed in any position, even in an intermediate position. The hinged connection for the pivotable mounting may be equipped with a scale and with means for fixation, pursuant to values shown on the scale, for the length of time the material which is to be ground remains in the apparatus. The chassis of support means may be in the form of a column having a base plate; at or near the upper end of the column, the housing, together with its grinding members, may hang over to one side, an electric motor may hang over on the other side, with both the electric motor and the housing being pivotable in common and being mounted in such a way that they can be fixed in any position. The housing for the grinding members, the cover of the shaft, and the outer casing of the electric motor may be designed together as a uniform and essentially cylindrical body.

The fixed cylindrical body may be in the form of a housing which is open on one side and has an end wall, and in which the roller body is rotatably mounted in an overhung arrangement on a shaft which on its opposite end is coupled with the rotor shaft of an electric motor, with the roller body, the shaft, and the rotor shaft being disposed in such a way that they extend coaxially. The shaft which holds and drives the roller body may be in the form of a hollow shaft, and at one end receives in its hollow interior an easily removable shaft neck which is preferably formed integrally onto the roller body and firmly holds the latter in place on the shaft in a self-supporting manner. The shaft may be accommodated in the upper part of the column, where it is supported by flanged bearings on which there is mounted on the outside thereof on one side of the column the electric motor, and on the other side of the column the outer housing which receives the grinding apparatus via the resilient bearing blocks. The outer housing, together with the housing for the cylindrical body, may be mounted on the column in an easily removable manner by means of attachment screws.

The outside of the cylindrical body or the housing therefor may be provided with means for increasing the surface area thereof, especially with longitudinal ribs, for dissipating heat. A cooling air generator may be disposed in the vicinity of such a housing which is provided with an increased surface area. The drive shaft of the roller body may be provided with fan blades which have a slope which conveys cooling air over the surfaces of the housing. The cooling air generator may be mounted on the shaft which drives the roller body, and the interior of the column may be constructed as an intake connection for the cooling air. In the direction of conveyance of the cooling air generator, and in the vicinity thereof, there may be disposed a funnel which tapers in this direction and is in the form of a nozzle for concentrating the cooling air which passes over the housing of the grinding apparatus. The coaxial and successive arrangement of the grinding apparatus, the shaft, and the electric motor may be in the form of a linear cooling air channel, with cooling air intake openings being provided on the side of the electric motor, and cooling air exhaust openings being provided on the side of the discharge conduit for the material which is ground, while the cooling air generator may be located on the shaft in the middle region of the arrangement.

The outer surface of the roller body may be provided with two flattened portions which extend over the entire length thereof and abut one another in a roof-like manner along a ridge formed by a narrow strip of the outer surface of the roller body.

A collecting container for the ground material may be connected to the discharge opening or to the discharge conduit, so that this container will follow the pivoting movements of the grinding apparatus.

With the present invention, a grinder is made available in an advantageous manner for laboratory operation; not only can coal and coke be pulverized in the grinder as examples of relatively soft materials, but also, for example, limestone, cement, and very hard ores can be pulverized, with the granular size introduced preferably being up to about 8 mm, while a granular size of up to about 10 microns can be achieved in the discharge. Of course, the difference in granular sizes need in no way be limited in each case to this aforementioned range; rather, smaller spans in the difference of granular sizes can also be established. The inventive apparatus can handle a hardness range of 3–10 degrees on the Mohs hardness scale.

An essential feature of the inventive apparatus consists in that the roller body which rotates within the fixed cylindrical body carries out wobbling or skipping movements during the operation within the body; actually, the roller itself is not subjected to these movements, but rathr a corresponding action is caused in that the cylinder body can move slightly relative to the roller, and in particular preferably under the influence of yielding components, for examle mechanical compression springs or hydraulic pressure mechanisms. The movements in the apparatus effected in this manner contribute to conveying the material stream from the point of introduction to discharge, and also prevent sticking in the grinding region. Dry as well as wet material can be processed in the inventive grinding apparatus.

BRIEF DESCRIPTION OF THE DRAWINGS

Illustrated in the drawing is one embodiment of the present invention, which will be described subsequently.

Shown is.

DETAILED DESCRIPTION OF PREFERRED EMBODIMENTS

Figure 1:
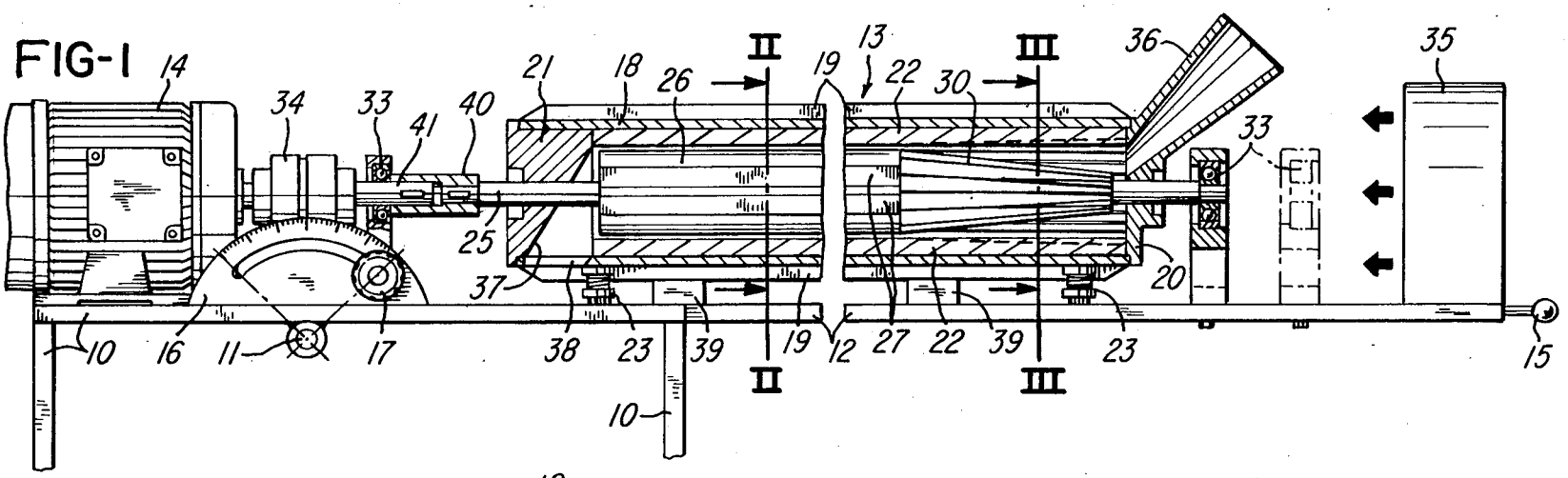
FIG. 1 a side view of the grinding apparatus, partially axially and longitudinally sectioned, FIG. 2 a cross sectional view taken along line II—II in FIG. 1, FIG. 3 a cross sectional view taken along line III—III in FIG. 1, FIG. 4 a side view of the grinding apparatus in the raised position, FIG. 5 a side view showing two operating positions of another embodiment of the grinding apparatus having a column-like stand, FIG. 6 a side view of the grinding apparatus of FIG. 5, partially axially and longitudinally sectioned.

With the embodiment of the grinding apparatus illustrated in FIGS. 1–4, a mounting plate 12 is pivotably mounted about a shaft 11 on a table-like supporting frame 10; on one side of the shaft 11, the mounting plate 12 supports a fine grinding or pulverizing apparatus 13, and on the other side of the shaft 11 the plate 12 supports an electrical drive motor 14. By means of handles 15, the mounting plate 12 with the grinding apparatus 13 and the motor 14 can be pivoted about the shaft 11 (see FIG. 4); the tilt or pivot angle is 90°, and all intermediate positions can be infinitely adjusted. In order to precisely establish the angle of inclination, there is provided a scale 16 having a knurled wheel 17 which acts upon a suitable clamping device (not illustrated) which fixes the mounting plate 12 in the desired position.

The grinding apparatus 13 comprises a tubular housing 18 of steel or light-metal castings, and is provided on the outside with numerous longitudinally extending cooling ribs 19. The end faces of the housing 18 are closed off by closure caps 20, 21 which have different constructions and make possible the introduction and discharge of the material in a manner which is to be described subsequently. A fixed grinding member in the form of a cylindrical body 22 is disposed within the housing 18; the cylindrical body 22 cannot move relative to the housing, and is made, for example, of steel or ceramic. The inner surface of the body 22 is absolutely cylindrical and smooth, and is preferably highly ground or polished.

The housing 18 rests on bearing blocks 23, each of which is essentially formed by a compression spring 24, as a result of which the housing is not only movable within limits, but also relatively speaking has a tendency to exert an upward force.

A second cylindrical or roller body 26 is disposed on an axially extending shaft 25 within the housing 18 along with the cylindrical body 22; the outer diameter of the cylindrical body 26 is smaller than the inner diameter of the cylindrical body 22 to such an extent that a cylindrical annular gap of about 0.2–0.4 mm width results between these two parts. The surface of the roller body 26 is also very finely smoothed or polished, and with the exception of two flattened or champfered portions 27, is absolutely cylindrical. The positioning of champfered portions 27 can be seen from FIG. 2; these portions are disposed next to one another, and abut one another in a roof-shaped manner, resulting in a narrow ridge surface 28 which extends as a continuation of the outer surface of the roller body. As a result of the champfered portions 27 there results within the apparatus two adjacent longitudinal chambers 29, which essentially have circle-segment-shaped cross sections. The roller body 26 particularly comprises steel and to the extent possible has the same hardness as does the cylindrical body 22. The hardness of both of the grinding members 22, 26 should be greater than the hardness of the material which is to be ground.

Figure 3:
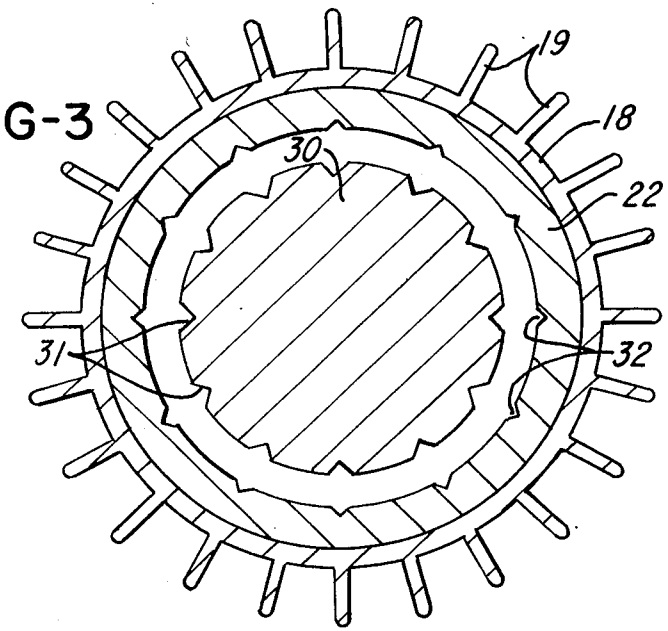
Figure 2:
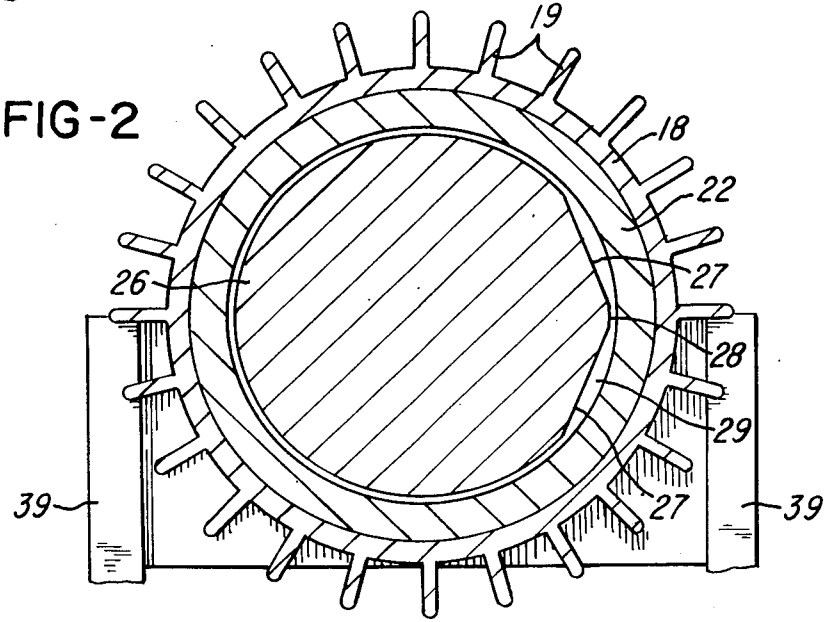
Figure 4:
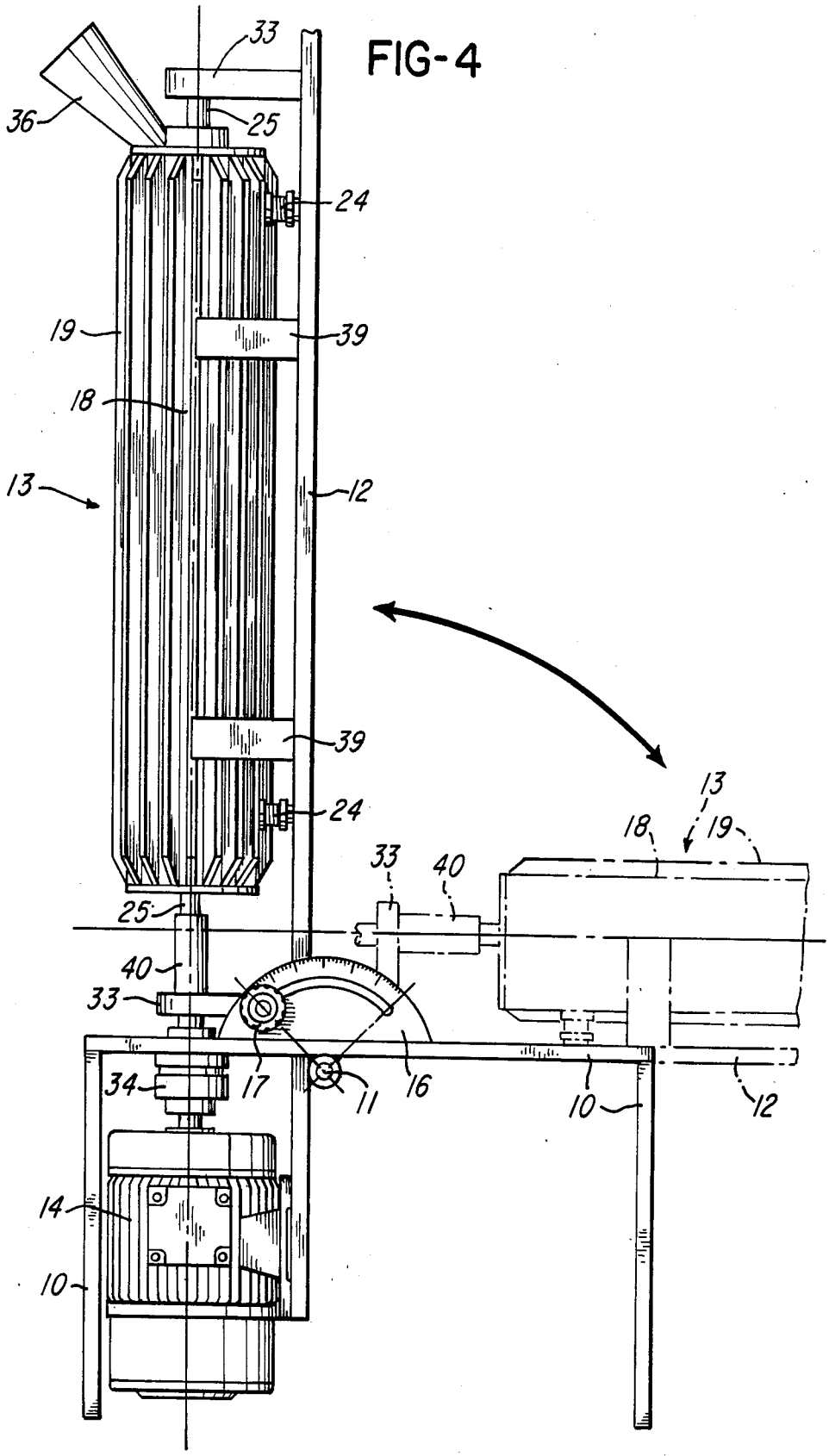

With the embodiment illustrated in the drawings, there is disposed at the right end face of the roller body 26 a conical body 30 as a preliminary grinding member. The surface of the conical body 30 merges smoothly into the surface of the roller body 26; however, the surface of the conical body 30 is provided with triangular grooves 31 which extend in the axial direction with their greatest cross sectional area being at the narrow end of the conical body 30 and their smallest cross sectional area being at the wide end of this body. In the region of the conical body 30, the inner surface of the cylindrical body 22 can also be provided with corresponding parallel grooves 32, as shown in FIG. 3.

The shaft 25 of the combined roller-conical body 26, 30 is mounted in easily operating roller bearings 33, and the shaft 25 has a fixed drive connection via a coupling 34 with the shaft of the electric motor 14. In this manner, the motor transmits to the rotating grinding member 26, 30 a speed of, for example, 3000 rpm. A cooling fan 35, which is also disposed on the mounting plate 12, can be driven by the motor 14 from the same shaft 25. The cooling fan generates an air stream over the housing 18 and the cooling ribs 19 thereof.

As previously mentioned, the closure caps 20, 21 are appropriately constructed for the introduction and discharge of the material which is to be ground; in particular, the closure cap 20 disposed at the introduction side is provided with a funnel or hopper 36 which opens into the upper half of the body 22 in the region of the narrow end of the conical body 30. The closure cap 21 on the discharge side of the housing 18 is provided on the inside with an incline 37 which opens into a lower opening 38 through which the ground material leaves the grinder. During the operation, a constant flow of material results from the hopper 36 to the opening 38; i.e., there is effected a continuous grinding process as long as new material is delivered to the hopper 36.

During operation, the unprocessed material passes initially from the opening of the hopper 36 into the region of the conical body 30, where a preliminary grinding takes place. The granular size obtained in this manner must correspond to the annular gap between the body 22 and the roller body 26. A continuous grinding then takes place in this annular gap as the material passes forward in the direction of the closure cap 21, whereby the material itself, although not exclusively, acts as a grinding tool. The longitudinal chambers 29 formed by the champfered portions 27 essentially serve to transport in the radial direction and to prevent clogging due to the formation of clumps. The longitudinal edges of the chambers 29 participate to a certain extent in the grinding process.

The conveyance of the material which is to be ground in the axial direction of the apparatus is effected only to a slight extent by the influence of the constantly supplied unprocessed material via the hopper 36; rather, the conveyance is primarily brought about by the inclination which can be imparted to the housing 18 by pivoting it about the shaft 11. The steeper the inclined position of the grinder, the quicker the material passes through the various grinding zones, so that the length of time the material remains between the grinding members is a direct function of the angle of inclination. The grinding degree is generally also dependent upon the inclination, although the hardness of the material also plays a role in this case.

A further aspect to consider is the moisture content of the unprocessed material; the wetter this material is, the finer it can generally be ground. It is precisely with wet material that the scraping or rubbing effect of the longitudinal edges of the champfered portions 27 are significant; i.e. the edges act as doctor blades.

During grinding, the position of the housing 18 on the compression springs 24 plays an important role, because as a result of this the body 22 is pressed upwardly, and the lower half of its inner surface is pressed against the lower half of the outer surface of the roller body 26. Since in operation the housing 18 carries out skipping movements, there result between the grinding members motion phenomena which enhance the grinding. So that the vibrations of the housing 18, in particular with resonant vibrations which cannot be ruled out, are held within limits, support plates 39 are provided which enclose the housing 18 with some play.

When a given grinding program is terminated and a new program is adopted with different unprocessed material and possibly with different grinding conditions, the apparatus must be cleaned. Since the discharge of ground material is utilized for laboratory purposes, it is important that no residue from previous programs be contained in the actual material which is to be ground at any given time; i.e. it must be possible to clean the apparatus very carefully. So that as a result thereof a lot of time is not lost, it is also important that it be possible to easily undertake the cleaning. This is assured with the apparatus of FIG. 1 by providing in the drive shaft unit 25, 33, 34 a coupling member 40 which essentially comprises a coupling sleeve which is seated on the shaft 25 and can be pushed back against spring pressure on the shaft 25 to such an extent that the adjacent shaft end 41 is released. It is now possible to grasp the housing 18, to lift it, and to withdraw it at an angle from the top out of the bearing 33 on the introduction side. The closure caps 20, 21, which are mounted in a conventional manner in the tubular ends of the housing 18, can be easily removed, whereupon the roller body 26 can now be withdrawn. The grinding members 22, 26, 30 can thus be easily and completely cleaned. The subsequent assembly of the apparatus can also proceed easily and quickly. Even during a grinding operation it is no particular problem to disassemble the roller body 26 in the aforementioned manner in the event, for example, disruption should occur due to the entry of a foreign object. None of these circumstances preclude the possibility of also utilizing the described grinding apparatus, with appropriate dimensioning, in connection with a continuous production operation.

Figure 5:
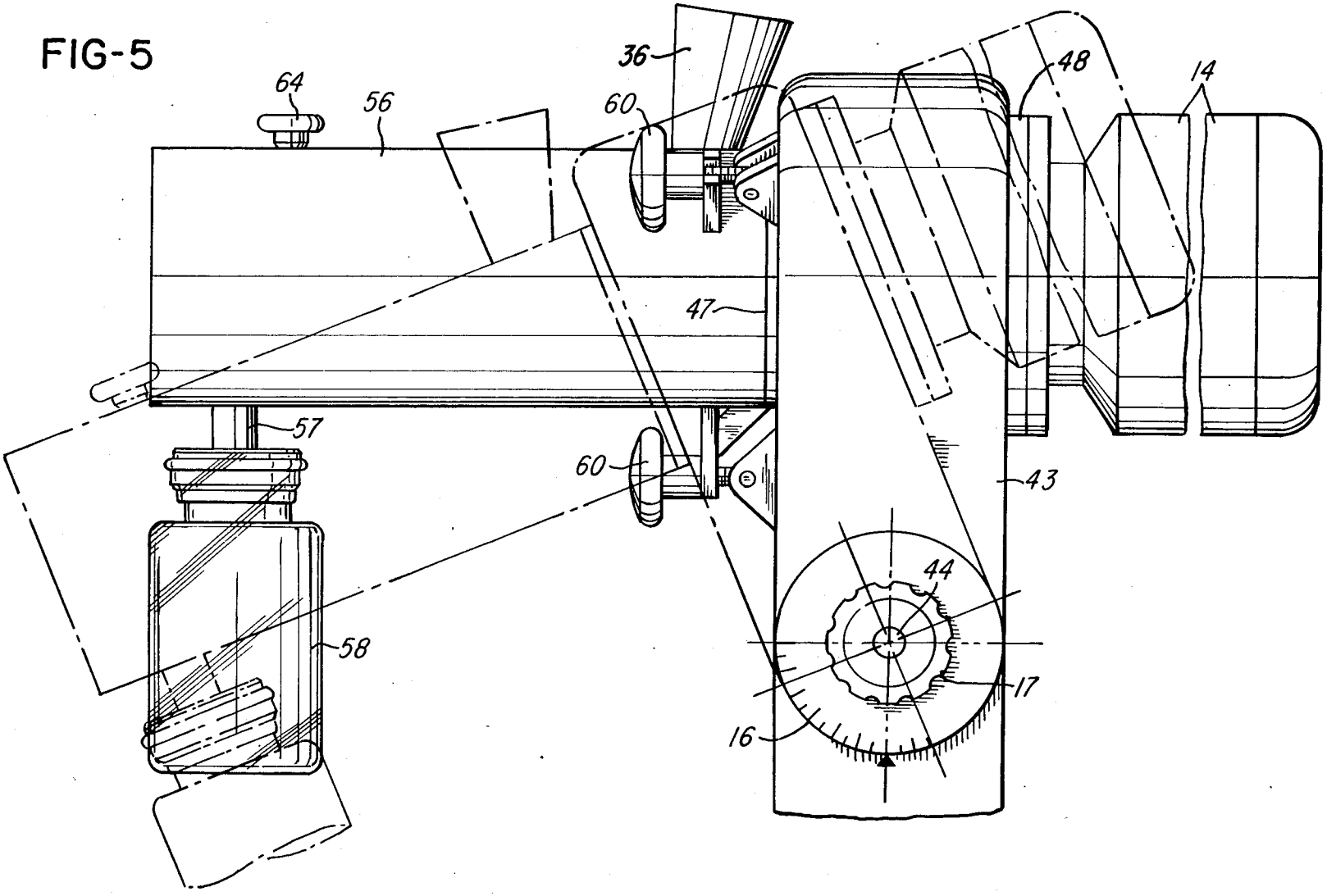
Figure 6:
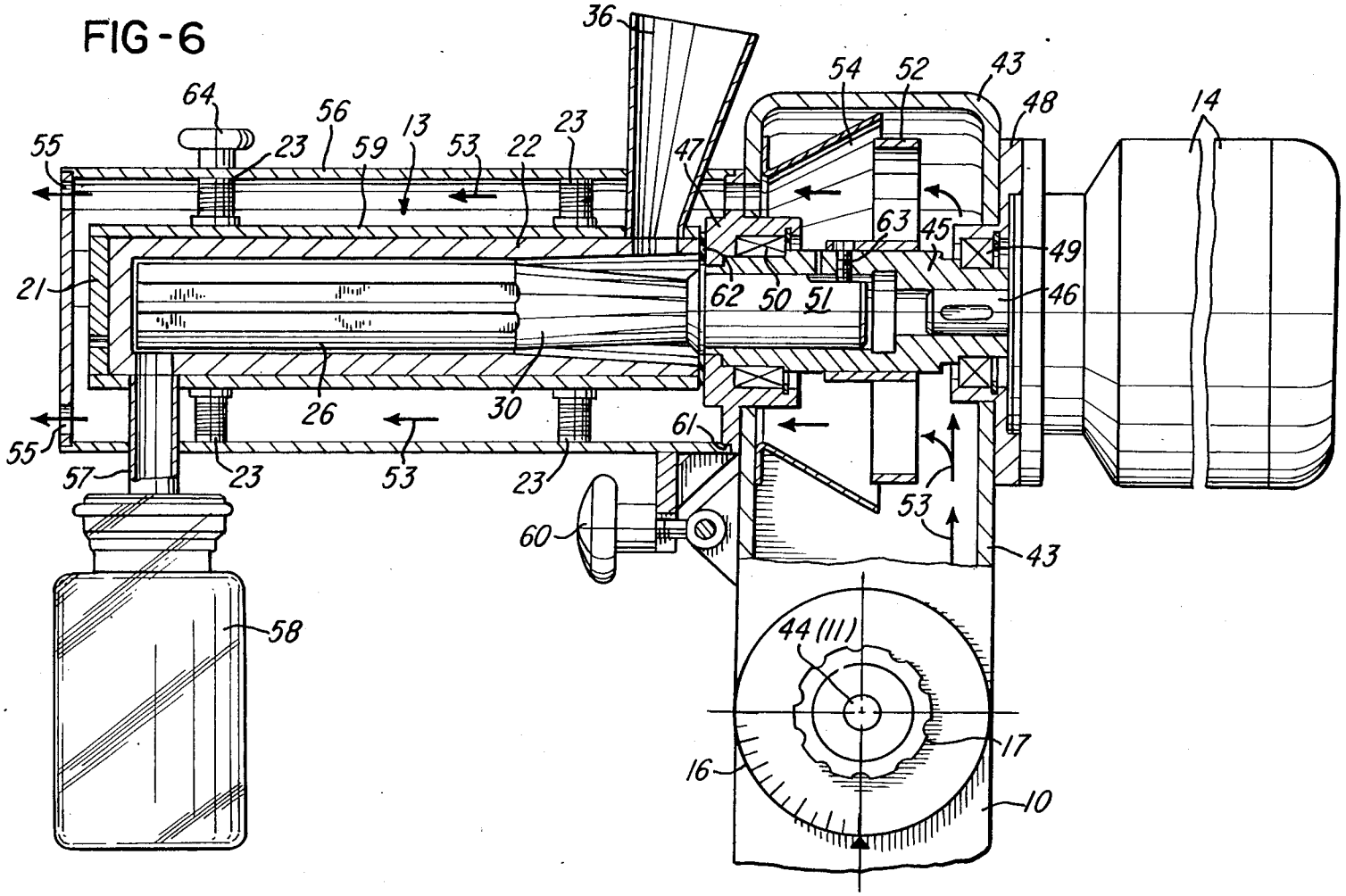

A further embodiment is illustrated in FIGS. 5 and 6, and differs primarily from the embodiment of FIGS. 1–4 in the construction of the chassis or supporting frame, and in the mounting of the grinding members and the electric motor. This embodiment involves a table or bench model having a stand or column 43 which projects up from a non-illustrated base plate, and is constructed in its middle portion as a hinged or pivot bearing 44. The latter has a scale 16 and a knurled wheel 17, which acts upon a suitable clamping device (not illustrated) which fixes the grinding apparatus in the desired position, for example in the inclined position shown by dot-dash lines in FIG. 5.

Whereas with the embodiment of FIGS. 1–4 the shaft 25 which supports the roller body 26 is mounted at both ends of the roller body, with the embodiment of FIGS. 5 and 6 an overhung mounting is provided; in other words, only one end of the roller body 26 is connected to the associated drive shaft, here the shaft 45, so that it projects into the cylindrical body 22 in a self-supporting manner. The cylindrical body 22 is also held in a self-supporting manner, and the same arrangement principle is also inplemented on the opposite side of the shaft 45, where the electric motor 14 with the rotor shaft 46 is located in a similar self-supporting arrangement. However, both ends of the rotor shaft are mounted in a conventional manner in the motor housing (not illustrated). In this manner, there results a 3-part arrangement of the components, namely in the middle the shaft 45, and coaxial thereto and on both sides thereof the electric motor 14 and the roller body 26 with the body 22. With this construction, the pivot axis for inclining the grinding members 22 26 is located in the central region, namely below the shaft 45 in the pivot bearing 44. In so doing, among other things, a particularly good handling ability of the apparatus is also achieved.

FIG. 6 shows in detail the embodiment which is only superficially illustrated in FIG. 5. Above the pivot bearing 44, the column 43, which projects up from the bottom, has a box-like hollow construction, and serves as the support for the shaft 45 and hence also for the components which are disposed in a self-supporting manner on both sides thereof, namely the grinding members 22, 26, and the motor 14 with the rotor shaft 46. For this purpose, bearing flanges 47, 48 are mounted in the wall of the upper part of the column 43 in appropriate openings; disposed in these bearing flanges are ball bearings or roller bearings 49, 50, between which extends the shaft 45. This shaft 45 is a hollow shaft in the form of a sleeve which open at both sides and has different inner diameters (see FIG. 6). The interior of the shaft 45 on the motor side serves to tightly receive the rotor shaft 46 of the electric motor 14, whereas on the other side the shaft 45 serves to receive a shaft neck 51 which is integral with the roller body 26. In this manner, the shaft 45 forms a coupling connection between the motor 14 and the roller body 26.

Supported on the outer periphery of the shaft 45 is a blade wheel 52 of an axial-flow fan which rotates with the shaft 45. In this way, cooling wind is drawn in in the direction of the arrows 53 from below through the upper part of the column 43, and after being deflected at right angles and being concentrated by a nozzle-like deflector 52, is conveyed over the grinding membe 22, 26. Although the intake openings for the cooling wind are not illustrated in the column 43, the exit openings for the used cooling medium are shown with the reference numerals 55 in FIG. 6.

Whereas bolted on the flange 48 externally of the column 43 is the electric motor 14, which for this purpose is constructed as a flanged motor, connected to the other flange 47 is a sleeve-like housing 56 in which is accommodated the grinding members 22, 26 along with the feed hopper 36 and the discharge conduit 57. Connected to the discharge conduit 57 is a bottle 58 for collecting the ground material. The outer jacket 59 of the cylindrical grinding member 22 is yieldingly supported within the housing 56 via the resilient bearing blocks 23, so that the body 22, which surrounds the roller body 26, can move relative to the latter should this become necessary, for example due to the accumulation of material or the presence of foreign objects. The housing 56 is mounted on the column 43 by means of three attachment screws 60, which are loosened in a conventional manner in order to remove the housing 56, and can each be pivoted to the outside. To mount the housing 56 on the column 43, the open edge of the housing is shoved over the appropriately stepped outer edge 61 of the flange 47, whereby the annular edge of the body 22 rests against a resilient seal 62; subsequently, the attachment screws 60 are tightened. As a result of this manner of construction, the body 22 can be removed very easily from the roller body 26, for example for cleaning or for exchange for a different body 22 which is more suitable for the next grinding process.

In this embodiment also, the roller body 26 is combined with a conical body 30 as a preliminary grinding member. The surface of the conical body 30 merges smoothly into the surface of the roller body 26, as was the case with the embodiment of FIGS. 1–4. However, in this embodiment there is connected to the conical body 30 the shaft neck 51 with which the inner grinding member 26 can be easily replaceably connected to the shaft 45. A setscrew 63 serves to secure this connection.

During operation, the processes occur in the manner already described in connection with the embodiment of FIGS. 1–4. The skipping movements of the body 22 or 59 relative to the roller body 26 described in connection with the previous embodiment, with the embodiment of FIGS. 5 and 6, can be influenced by an adjusting screw 64 which acts upon the outer bearing block 23.

The features disclosed in the specification, the claims, the drawings, and the abstract can be essential either individually or in any combination with one another for realizing the various embodiments of the present invention.

What I claim is:

1. An apparatus for attaining effect of both point-for-point impacting and pulverizing fine grinding of material samples, said apparatus including a fixed grinding member and a rotating grinding member, said members having respective surfaces which face one another and are slightly spaced from one another, with the material which is to be ground being received and passed between these surfaces; the improvement in combination therewith which comprises:

a cylindrical body as said fixed grinding member, said cylindrical body being fixed against rotation and having an inner surface;

a roller body as said rotating grinding member; said roller body has an outer surface, rotates in said cylindrical body, and is disposed substantially coaxially in the latter in such a way that a small annular gap remains between said cylindrical body and said roller body; said roller body has two end faces, with feed means being disposed at one of said end faces, and discharge means being disposed at the other of said end faces; the material which is to be ground is conveyed through said annular gap from said feed means to said discharge means;

a housing which surrounds said cylindrical body;

resilient bearing blocks upon which said housing is mounted in such a way that the lower half of said inner surface of said cylindrical body is pushed upwardly against the lower half of said outer surface of said roller body; and means for adjusting the level or resiliency of said bearing blocks for said cylindrical body;

said outer surface of said roller body being provided with two flattened portions which extend over the entire length thereof and abut one another in a roof-like manner along a ridge formed by a narrow strip of said outer surface of said roller body.

2. An apparatus according to claim 1, in which each of said resilient bearing blocks is essentially formed by a compression spring.

3. An apparatus according to claim 1, in which said cylindrical body and said roller body have a common central longitudinal axis which is basically horizontal; and which includes means for pivoting said central longitudinal axis through numerous inclined positions up to an essentially vertical position.

4. An apparatus according to claim 3, which includes a drive unit operatively connected to said roller body; and which includes support means on which is mounted said drive unit and said housing, together with its components; said support means is provided with a hinged connection via which it can be pivoted through approximately 90° between a horizontal and a vertical position, with said support means being adapted be fixed in any position throughout said 90° range.

5. An apparatus according to claim 4, which includes a receiving container for ground material connected directly to said discharge means, so that said container follows pivoting movements of said housing for said grinding members.

6. An apparatus according to claim 4, in which said hinged connection for the pivotable positioning of said support means includes a scale, and means for effecting said fixing of said position of said support means, pursuant to values shown on said scale, for the length of time the material which is to be ground remains in said apparatus.

7. An apparatus according to claim 4, in which said support means is in the form of a column having a base plate; at or near the upper end of said column, said housing, together with its components hangs over to one side, and said drive unit hangs over to the other side, with said housing and said drive unit being pivotable together with said column, which can be fixed in any position.

8. An apparatus according to claim 7, in which said roller body is mounted for rotation on a shaft which is operatively connected to said drive unit; which includes a cover for said shaft; and in which said drive unit has an outer casing; said housing for said grinding members, said cover, and said outer casing are formed together as a uniform and essentially cylindrical member.

9. An apparatus according to claim 7, in which said drive unit is an electric motor and has a rotor shaft; in which said roller body is mounted for rotation in an overhung arrangement in said cylindrical body on one end of a shaft, the opposite end of which is coupled to said rotor shaft; and in which said fixed cylindrical body and said housing which surrounds it together are in the form of a housing which is open at one end and has an end wall at the other end; said roller body, said shaft, and said rotor shaft are disposed in such a way that they extend coaxially.

10. An apparatus according to claim 9, which includes a cooling air generator; and in which said housing with said grinding members, said shaft for driving said roller body, and said electric motor are coaxially and successively arranged in such a way as to form a linear cooling air channel, with cooling air intake openings being provided on the side of said electric motor, and cooling air exhaust openings being provided on the side of said discharge means for said ground material; said cooling air generator is disposed in a central region on said shaft.

11. An apparatus according to claim 9, in which said shaft which holds and drives said roller body is a hollow shaft; and in which said roller body includes a shaft neck which is easily removably received in the hollow interior of said hollow shaft at one end thereof to effect said mounting of said roller body on said shaft in such a way that said roller body is mounted in a self-supporting manner.

12. An apparatus according to claim 11, which includes an outer jacket in which said housing, together with its components, is mounted via said resilient bearing blocks; said hollow shaft is accommodated in the upper portion of said column, where it is held by means of flanged bearings which are connected to said column; mounted on the outside of said flanged bearings on one side of said column is said electric motor, and on the opposite side of said column is said outer jacket.

13. An apparatus according to claim 12, which includes attachment screws for connecting said outer jacket, together with said housing and its grinding member components, to said column in an easily removable manner.

14. An apparatus according to claim 7, in which the outside of said housing for said cylindrical body is provided with means for increasing the surface area thereof for the dissipation of heat.

15. An apparatus according to claim 14, which includes a cooling air generator disposed in the vicinity of said housing having said increased surface area.

16. An apparatus according to claim 15, in which said shaft for driving said roller body is provided with fan blades which have a slope for conveying cooling air over the surface of said housing.

17. An apparatus according to claim 15, in which said cooling air generator is mounted on said shaft which drives said roller body; and in which the interior of said column is in the form of an intake connection for cooling air.

18. An apparatus according to claim 17, in which a funnel, in the form of a nozzle for concentrating cooling air which is to pass over said housing for said cylindrical body, is disposed in the direction of conveyance of said cooling air generator and in the vicinity thereof; said funnel tapers in this direction.

* * * * *